US010859043B2

(12) United States Patent
Park

(10) Patent No.: US 10,859,043 B2
(45) Date of Patent: Dec. 8, 2020

(54) DEVICE FOR ENHANCING FUEL EFFICIENCY

(71) Applicant: Jong Pyo Park, Gimpo-si (KR)

(72) Inventor: Jong Pyo Park, Gimpo-si (KR)

( * ) Notice: Subject to any disclaimer, the term of this patent is extended or adjusted under 35 U.S.C. 154(b) by 0 days.

(21) Appl. No.: 16/335,715

(22) PCT Filed: Sep. 27, 2017

(86) PCT No.: PCT/KR2017/010725
§ 371 (c)(1),
(2) Date: Mar. 22, 2019

(87) PCT Pub. No.: WO2018/062849
PCT Pub. Date: Apr. 5, 2018

(65) Prior Publication Data

US 2019/0242333 A1 Aug. 8, 2019

(30) Foreign Application Priority Data

Sep. 29, 2016 (KR) ..... 10-2016-0125776

(51) Int. Cl.
*F02M 29/06* (2006.01)
*F02M 27/00* (2006.01)
*F15D 1/00* (2006.01)

(52) U.S. Cl.
CPC ..... *F02M 27/00* (2013.01); *F02M 29/06* (2013.01); *F15D 1/0015* (2013.01); *F02M 2700/4361* (2013.01)

(58) Field of Classification Search
CPC ..... F02M 27/00; F02M 29/02; F02M 29/06; F02M 2700/4361; F15D 1/00; F15D 1/0015
USPC ..... 123/536–538
See application file for complete search history.

(56) References Cited

U.S. PATENT DOCUMENTS 5,307,779 A 5/1994 Wood et al.
5,487,370 A * 1/1996 Miyazaki ..... F02M 27/045 123/538
6,024,073 A * 2/2000 Butt ..... F02M 27/02 123/538

(Continued)

FOREIGN PATENT DOCUMENTS

KR 10-2005-0025693 A 3/2005
KR 10-2011-0136599 A 12/2011

(Continued)

*Primary Examiner* — John Kwon
*Assistant Examiner* — Johnny H Hoang
(74) *Attorney, Agent, or Firm* — Korus Patent, LLC; Seong Il Jeong

(57) ABSTRACT

The present invention provides a device for enhancing fuel efficiency, the device including: a first casing in which first and second rotating pulverizers are disposed at both ends of a first injection hole at the center of the first casing and a fuel inlet is disposed on a first side of the first casing; a connection part which is disposed on a second side of the first casing and in which a second injection hole is formed in the center of the connection part; a second casing which is disposed on a second side of the connection part and in which a fuel outlet is disposed on a second, discharge hole side of the second casing; and a fuel guide means which is disposed inside the second casing and which includes first, second, third, and fourth guide tubes and first and second rotating guide tubes.

5 Claims, 6 Drawing Sheets

(56) References Cited

U.S. PATENT DOCUMENTS

| | | | | |
|---|---|---|---|---|
| 6,748,921 | B1 * | 6/2004 | Surges | F02B 31/04 123/306 |
| 7,434,569 | B2 * | 10/2008 | Wang | F02M 27/045 123/538 |
| 8,342,159 | B2 * | 1/2013 | Detore | F02M 37/0017 123/538 |
| 8,800,527 | B2 * | 8/2014 | McAlister | F02M 57/06 123/297 |
| 2005/0224058 | A1 * | 10/2005 | Kim | F02M 27/045 123/538 |

FOREIGN PATENT DOCUMENTS

| | | | |
|---|---|---|---|
| KR | 10-2013-0008738 | A | 1/2013 |
| KR | 10-2016-0099392 | A | 8/2016 |

* cited by examiner

DEVICE FOR ENHANCING FUEL EFFICIENCY

TECHNICAL FIELD

The present invention relates to a device for enhancing fuel efficiency, and more specifically to a device for enhancing fuel efficiency, which atomizes various types of fuel (e.g., gasoline, diesel, heavy oil, kerosene, etc.), injected into an engine, more desirably than conventional technology and thus enables the fuel to be completely combusted, so that energy efficiency may be maximized, with the result that various desires (needs) of consumers, i.e., users, may be met by considerably improving the quality and reliability of the device for enhancing fuel efficiency, thereby presenting a good image.

BACKGROUND ART

It is well known that when fuel preprocessing designed to allow oil, such as fuel oil or the like, to be exploded by compression and ignition in the state in which the physical properties of the oil have been improved after a preprocessing process is performed, fuel efficiency may be increased due to the improvement of combustion efficiency and also the contamination of the atmosphere attributable to incomplete combustion may be significantly reduced.

As an example, in conventional technology, there is a device for activating fuel by installing an acceleration rod configured to distribute fuel by compressing and expanding the fuel or device for activating fuel oil by repeating the compression and expansion of fuel by means of cylindrical distribution plates stacked in a plurality of layers while rotating the fuel at high speed.

However, the conventional technology is problematic in that the fuel of a fuel tank needs to be fed by means of an acceleration rod or rotating acceleration rod, so that fuel oil is not distributed desirably and the combustion efficiency of fuel is degraded.

In particular, the conventional technology has the following problems:

First, a first guide tube is not provided with an oil film formation portion, and thus the first guide tube cannot be leveled, with result that a problem arises in that the atomization of fuel is degraded.

Second, the first guide tube is not provided with an elastic element, and thus the front end of the first guide tube cannot maintain a predetermined distance to a second injection hole, with the result that a problem arises in that it is impossible to atomize fuel by distributing the fuel to the outside.

Third, a spiral discharge groove is not formed in a connection part, and thus a problem arises in that as a space is filled with fuel, the fuel is not distributed desirably.

Fourth, a single thread is formed on each of the outer circumferential surfaces of first and second rotating guide tubes, and thus problems arise in that fuel is not easily distributed and a fuel concentration phenomenon occurs.

Fifth, a problem arises in that it is impossible to connect and conveniently use a plurality of devices for enhancing fuel efficiency as desired.

Sixth, accordingly, a significant problem arises in that it is impossible to improve pulverization efficiency through smooth fuel supply and atomization.

Although the following prior art documents were disclosed in the past in order to overcome the above problems, a significant problem arises in that the above-described problems of the conventional technology are not still completely overcome.

PRIOR ART DOCUMENTS (Patent document 1) Korean Patent Application Publication No. 2013-0008738 (published on Jan. 23, 2013)

(Patent document 2) Korean Patent Application Publication No. 2011-0136599 (published on Dec. 21, 2011)

(Patent document 3) Korean Patent No. 1077852 (issued on Oct. 24, 2011) was issued.

(Patent document 4) Korean Patent No. 0593330 (issued on Jun. 19, 2006)

(Patent document 5) Korean Patent No. 0285998 (issued on Jan. 9, 2001)

DISCLOSURE

Technical Problem

The present invention has been conceived to overcome the above-described problems of the conventional technology; and to include a first casing, a connection part, a fuel guide means, a second casing, an inflow collection base, and a discharge collection base in a device for improving fuel efficiency is a first object, a second object of the present invention according to the above technical configuration is to maximize energy efficiency by atomizing various types of fuel (e.g., gasoline, diesel, heavy oil, kerosene, etc.) injected into an engine more desirably than the conventional technology so that the fuel can be completely combusted, particularly a third object is to level a first guide tube thanks to oil film formation because fuel passes through an oil film formation portion formed at the first front end of a first guide tube, a fourth object is to bring the front end of the first guide tube close to a second injection hole while always maintaining a predetermined distance by means of an elastic element, so that fuel is distributed to the outside and thus atomization time is secured, a fifth object is to form a spiral discharge groove on the connection part, so that fuel is rapidly transferred to the outside and is then atomized, a sixth object is to form two-line threads having two starting points on the outer circumferential surface of each of the first and second rotating guide tubes, so that a total of four threads decompose fuel and thus a large amount of fuel may be easily atomized without a concentration phenomenon, a seventh object is to connect and conveniently use a plurality of devices for enhancing fuel efficiency as desired, an eighth object is to improve pulverization efficiency through smooth fuel supply and atomization, and a ninth object is to provide a device for enhancing fuel efficiency, which may meet various desires (needs) of consumers, i.e., users, and thus provide a good image by considerably improving the quality and reliability of the device for enhancing fuel efficiency.

Technical Solution

In order to accomplish the above objects, the present invention provides a device for enhancing fuel efficiency, in order to maximize energy efficiency by atomizing fuel injected into an engine so that the fuel is completely combusted, the device including: a first casing in which first and second rotating pulverizers are disposed at both ends of a first injection hole at the center of the first casing and a fuel inlet is disposed on a first side of the first casing; a connection part which is disposed on a second side of the first casing and in which a second injection hole is formed in the center of the connection part; a second casing which is disposed on a second side of the connection part and in which a fuel outlet is disposed on a second, discharge hole side of the second casing; and a fuel guide means which is disposed inside the second casing and which includes first, second, third, and fourth guide tubes and first and second rotating guide tubes in order to atomize fuel by pulverizing it and to then transfer the pulverized fuel to a second side.

Advantageous Effects

As described in detail above, the present invention is configured such that the device for improving fuel efficiency includes the first casing, the connection part, the fuel guide means, the second casing, the inflow collection base, and the discharge collection base.

The present invention according to the above technical configuration is configured to maximize energy efficiency by atomizing various types of fuel (e.g., gasoline, diesel, heavy oil, kerosene, etc.), injected into an engine, more desirably than the conventional technology so that the fuel can be completely combusted.

In particular, the present invention is configured to level the first guide tube thanks to oil film formation because fuel passes through the oil film formation portion formed at the first front end of the first guide tube, Furthermore, the present invention is configured to bring the front end of the first guide tube close to the second injection hole while always maintaining a predetermined distance by means of the elastic element, so that fuel is distributed to the outside and thus atomization time is secured Moreover, the present invention is configured such that the spiral discharge groove is formed on the connection part, so that fuel is rapidly transferred to the outside and is then atomized.

Furthermore, the present invention is configured such that two-line threads having two starting points are formed on the outer circumferential surface of each of the first and second rotating guide tubes, so that a total of four threads decompose fuel and thus a large amount of fuel may be easily atomized without a concentration phenomenon.

Furthermore, the present invention is configured to connect and conveniently use a plurality of devices for enhancing fuel efficiency as desired.

Additionally, the present invention is configured to improve pulverization efficiency through smooth fuel supply and atomization.

The present invention is a very useful invention configured to provide the device for enhancing fuel efficiency, which may meet various desires (needs) of consumers, i.e., users, and thus provide a good image by considerably improving the quality and reliability of the device for enhancing fuel efficiency.

Preferred embodiments of the present invention for achieving these effects will be described in detail based on the accompanying drawings.

DESCRIPTION OF SYMBOLS OF PRINCIPAL COMPONENTS IN THE ACCOMPANYING DRAWINGS

Figure 1:
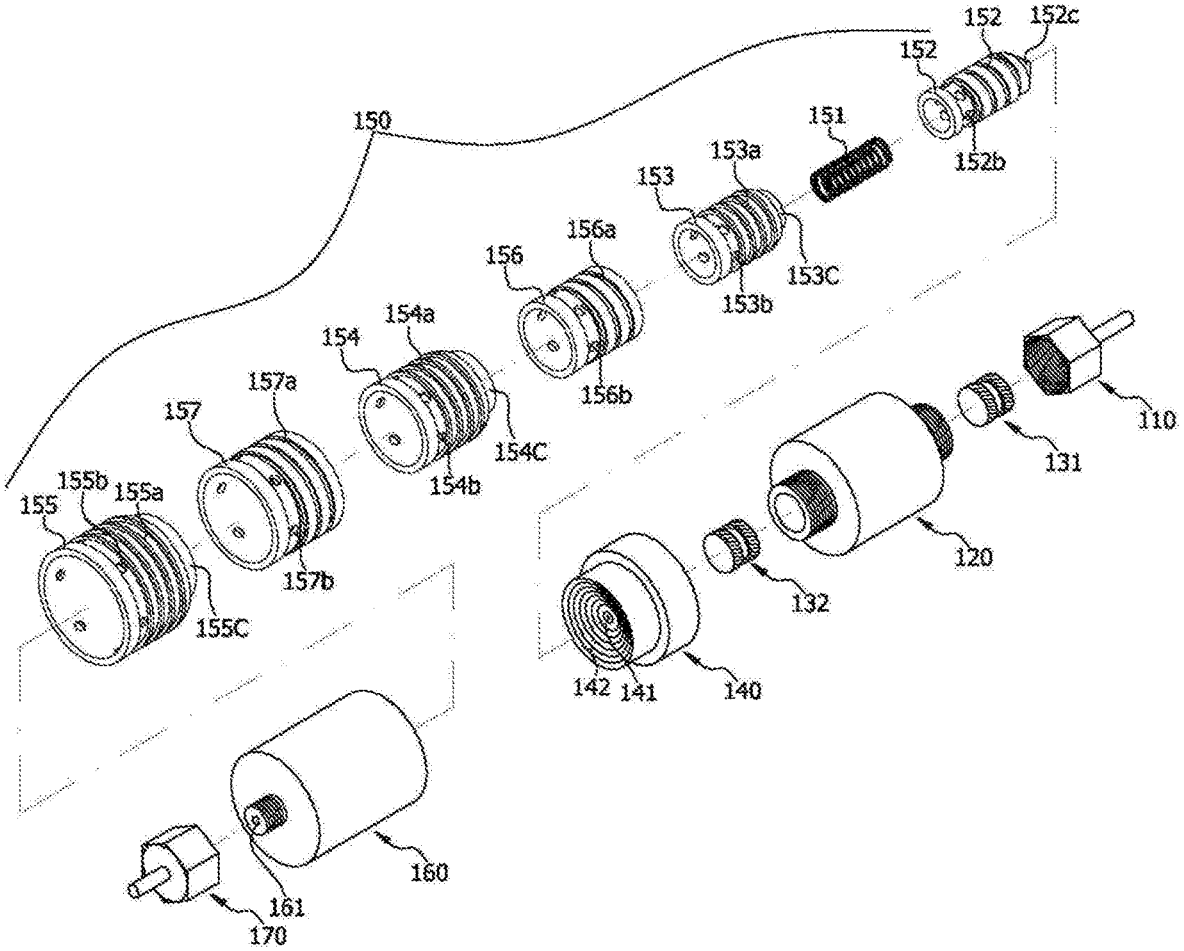
FIG. 1 is an exploded perspective view of a device for enhancing fuel efficiency, which is applied to the present invention.

100: device for improving fuel efficiency
120: first casing
140: connection part
150: fuel guide means
160: second casing
220: inflow collection base
230: discharge collection base

BEST MODE

A device for enhancing fuel efficiency, which is applied to the present invention, is configured as shown in FIGS. 1 to 6.

In the following description of the present invention, when it is determined that a detailed description of a related well-known function or configuration may unnecessarily make the gist of the present invention obscure, the detailed description will be omitted.

Furthermore, the following terms are the terms which are set by taking into account the functions thereof in the present invention. The definitions of the terms may vary depending on the intention of a producer or a practice, and thus the definitions of the terms should be made based on the context of the overall specification.

Furthermore, the sizes and thicknesses of respective components shown in the drawings are arbitrarily selected for ease of description, and thus the present invention is not necessarily limited to those shown in the drawings.

First, a device 100 for enhancing fuel efficiency according to the present invention enables the fuel injected into an engine to be completely combusted by atomizing the fuel, and includes the following technical configuration in order to maximize energy efficiency.

Figure 2:
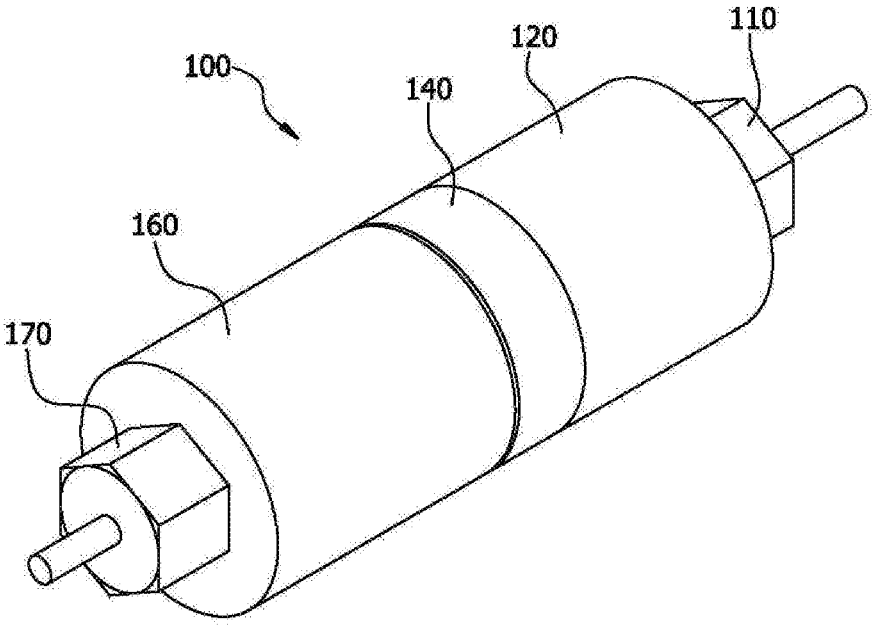
FIG. 2 is a perspective view of the assembled state of the device for enhancing fuel efficiency, which is applied to the present invention.
Figure 3:
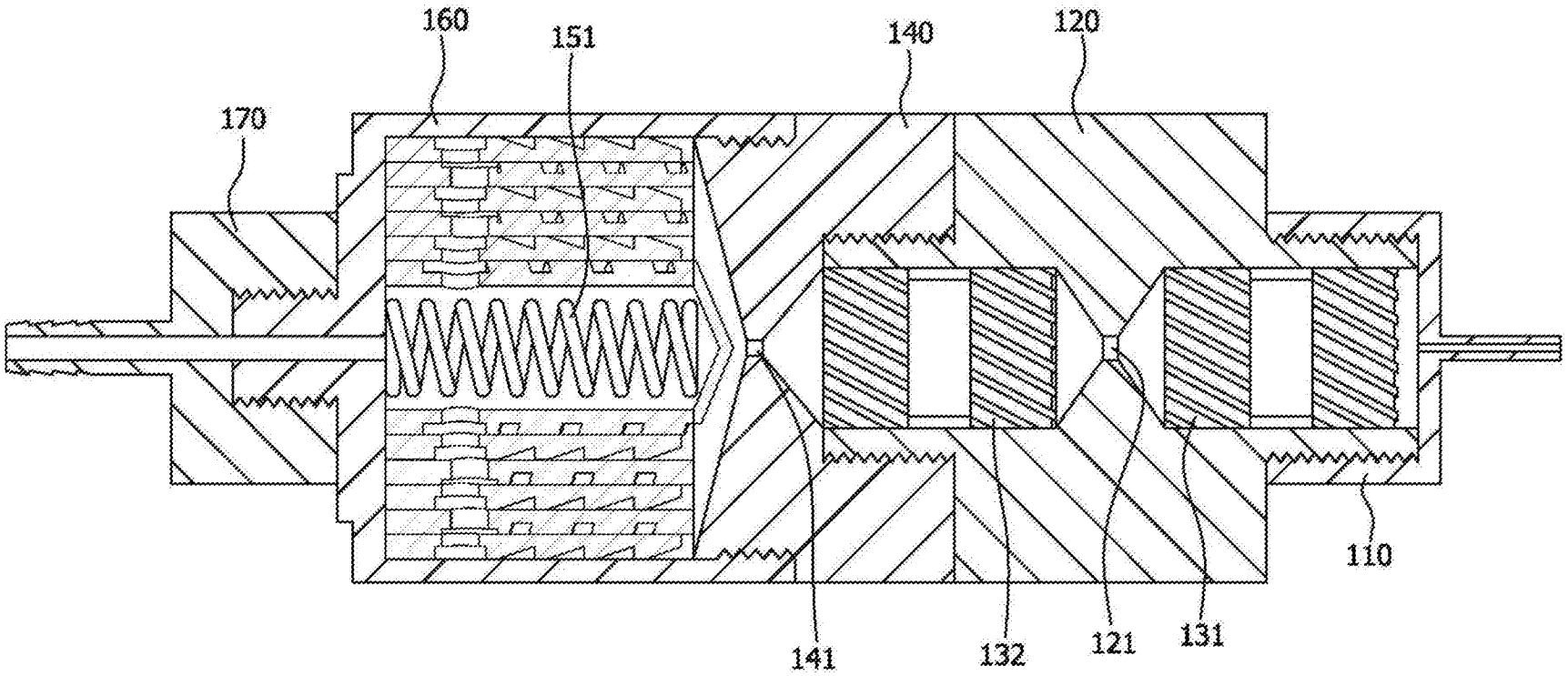
FIG. 3 is a sectional view of the assembled state of the device for enhancing fuel efficiency, which is applied to the present invention.

In other words, as shown in FIGS. 1, 2, and 3, the present invention includes a first casing 120 in which first and second rotating pulverizers 131 and 132 are disposed at both ends of a first injection hole 121 at the center of the first casing 120 and a fuel inlet 110 is disposed on one side of the first casing 120.

Furthermore, the present invention includes a connection part 140 which is disposed on the other side of the first casing 120 and in which a second injection hole 141 is formed in the center of the connection part 140.

In this case, a spiral discharge groove 142 is formed in the connection part 140 so that fuel can be rapidly transferred to the outside and then pulverized.

Furthermore, the present invention includes a second casing 160 which is disposed on the other side of the connection part 140 and in which a fuel outlet 170 is disposed on the discharge hole side, i.e., the other side, of the second casing 160.

In particular, the present invention includes a fuel guide means 150 which is disposed inside the second casing 160 and which includes first, second, third, and fourth guide tubes 152, 153, 154 and 155 and first and second rotating guide tubes 156 and 157 in order to atomize fuel by pulverizing it and to then transfer the pulverized fuel to the other side.

In this case, non-spiral, linear distribution portions 152*a*, 153*a*, 154*a* and 155*a* and fuel passage holes 152*b*, 153*b*, 154*b* and 155*b* are formed in the first, second, third, and fourth guide tubes 152, 153, 154 and 155.

Furthermore, spiral rotation portions 156*a* and 157*a* and fuel passage holes 156*b* and 157*b* are formed in the first and second rotating guide tubes 156 157.

In addition, an elastic element 151 is disposed inside the other side of the first guide tube 152 according to the present invention. The front end of the first guide tube 152 is brought close to the second injection hole 141 by the elastic element 151 while always maintaining a predetermined distance, and thus fuel is distributed to the outside so that atomization time can be secured.

Additionally, oil film formation portions 152*c*, 153*c*, 154*c* and 155*c* are formed on the outer circumferential surfaces of the front ends of the first, second, third, and fourth guide tubes 152, 153, 154 and 155 according to the present invention. Fuel passes through the oil film formation portions 152*c*, 153*c*, 154*c* and 155*c*, and thus first, second, third, and fourth guide tubes 152, 153, 154 and 155 may be leveled thanks to oil film formation.

Furthermore, according to the present invention, two or more multiple-line threads having two or more starting points are formed on the outer circumferential surface of each of the first and second rotating guide tubes 156 and 157 and decompose fuel, and thus a large amount of fuel may be easily atomized without a concentration phenomenon.

In the present specification, for the sake of convenience, there is illustrated a case where two two-line threads are formed and a total of four threads (a right thread, a left thread) (a left thread, a right thread) decompose fuel.

Figure 4:
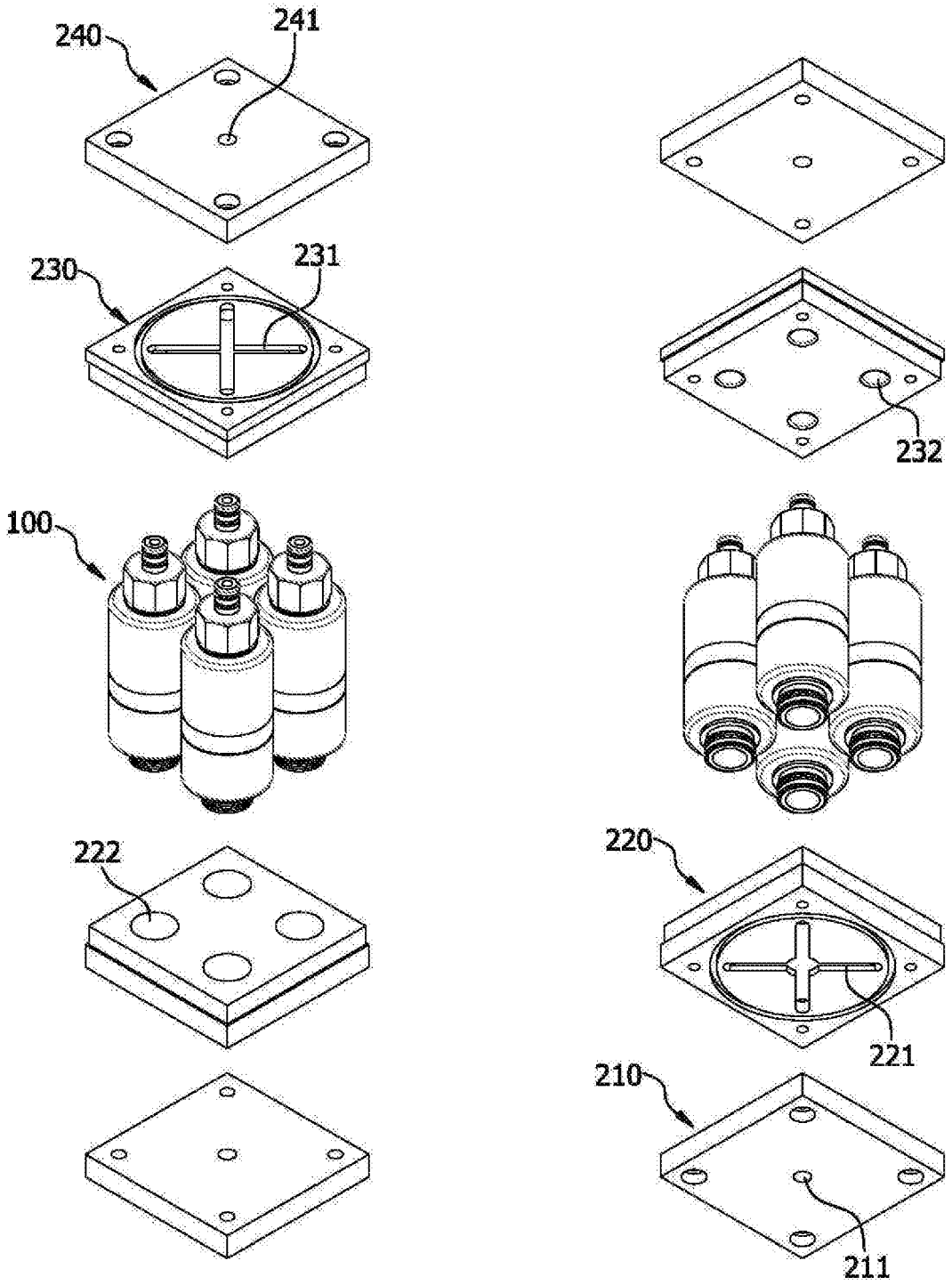
FIG. 4 is an exploded perspective view for the assembly of four devices for enhancing fuel efficiency, which are applied to the present invention.
Figure 5:
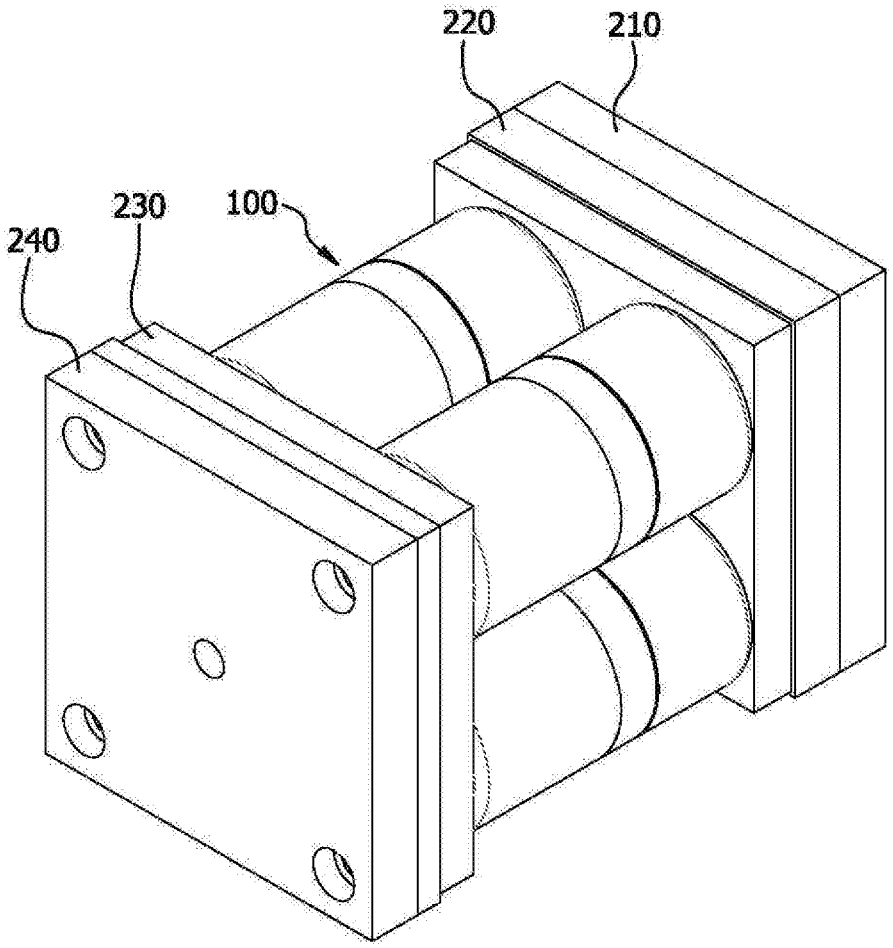
FIG. 5 is a perspective view of the assembled state of the four devices for enhancing fuel efficiency, which are applied to the present invention.
Figure 6:
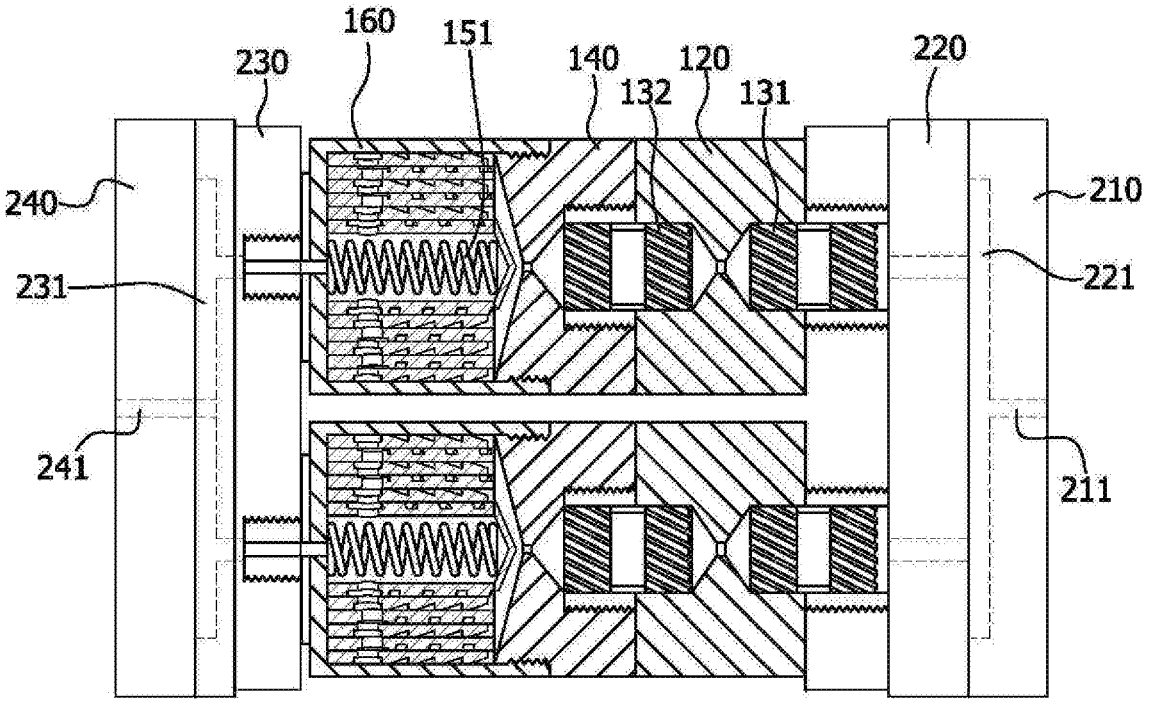
FIG. 6 is a sectional view of the assembled state of the four devices for enhancing fuel efficiency, which are applied to the present invention.

Meanwhile, the present invention may be used as shown in FIGS. 4, 5, and 6 so that a plurality of devices 100 for enhancing fuel efficiency can be connected and then used.

In other words, there is included an inlet hole cover 210 through which an inlet hole 211 is formed.

Furthermore, the present invention includes an inflow collection base 220 which is disposed on one side of the inlet hole cover 210 and in which a plurality of fuel inflow collection grooves 221 is formed on the side of the inflow collection base in contact with the inlet hole cover 210 and a plurality of first fastening holes 222 is formed on the opposite side of the inflow collection base.

Furthermore, the present invention includes a plurality of devices 100 for improving fuel efficiency which is disposed in the first fastening holes 222.

Furthermore, the present invention includes a discharge collection base 230 which is disposed on a first side of the devices 100 for improving fuel efficiency and in which a plurality of second fastening holes 232 is formed and a plurality of fuel discharge collection grooves 231 is formed on the opposite side thereof in contact with an outlet hole cover 240.

Furthermore, the outlet hole cover 240 through which an outlet hole 241 is formed is disposed on the discharge collection base 230 according to the present invention.

In particular, fuel introduced into the inlet hole 211 according to the present invention is distributed to the outside through the plurality of fuel inflow collection grooves 221, and is then fed to the plurality of devices 100 for improving fuel efficiency through the plurality of first fastening holes 222. The devices 100 for improving fuel efficiency pulverize and atomize fuel so that the fuel can be completely combusted. It is preferred that the fuel discharged from the plurality of devices 100 for improving fuel efficiency is passed through the second fastening hole 232, is fed from the outside to the inside through the fuel discharge collection grooves 231, and is discharged through the outlet hole 241.

Although a case where the four devices 100 for improving fuel efficiency are connected is illustrated in the present embodiment, this is illustrated merely for ease of description. It will be apparent that two, three, four, or more devices 100 for improving fuel efficiency may be connected and then used.

Meanwhile, the present invention may be modified in various manners and may have various forms when the above-described configuration is applied.

Furthermore, it should be understood that the present invention is not limited to the specific forms described in the detailed description, and rather it should be understood that the present invention includes all modifications, equivalents, and substitutions falling within the spirit and scope of the present invention defined by the attached claims.

The operation and effect of the device for enhancing fuel efficiency according to the present invention, which is configured as described above, will be described below.

First, the present invention atomizes various types of fuel (e.g., gasoline, diesel, heavy oil, kerosene, etc.), injected into an engine, more desirably than the conventional technology to thus enable the fuel to be completely combusted, thereby maximizing energy efficiency.

For this purpose, FIG. 1 is an exploded perspective view of a device for enhancing fuel efficiency, which is applied to the present invention, and FIG. 2 is a perspective view of the assembled state of the device for enhancing fuel efficiency, which is applied to the present invention. Furthermore, FIG. 3 is a sectional view of the assembled state of the device for enhancing fuel efficiency, which is applied to the present invention.

In the present invention device 100 for enhancing fuel efficiency, fuel passes through the first casing 120 through the fuel inlet 110. In this case, the fuel is primarily pulverized and atomized by the first rotating pulverizer 131. Thereafter, the fuel discharged through the first injection hole 121 is secondarily pulverized and atomized by the second rotating pulverizer 132.

The fuel atomized as described above passes through the second injection hole 141 of the connection part 140. In this case, the fuel is allowed to be rapidly distributed to the outside through the spiral discharge groove 142, and thus the fuel may be atomized more desirably.

Furthermore, according to the present invention, the fuel is pulverized and atomized more desirably while passing through the fuel guide means 150, thereby considerably improving fuel efficiency.

In other words, the fuel is discharged between the guide tubes. The fuel discharged through each distributor, each fuel passage hole, and each rotation portion is finely pulverized through turbulence, collision, and rotation.

In particular, in the above-described process, according to the present invention, fuel passes through the oil film formation portion 152*c* formed at the front end of the first guide tube 152, and thus the first guide tube 152 is leveled thanks to oil film formation.

Furthermore, according to the present invention, the front end of the first guide tube 152 is brought close to the second injection hole 141 by the elastic element 151 while always maintaining a predetermined distance, and thus fuel is distributed to the outside so that atomization time can be secured.

Furthermore, according to the present invention, two-line threads having two starting points are formed on the outer circumferential surface of each of the first and second rotating guide tubes 156 and 157 and a total of four threads decompose fuel, and thus a large amount of fuel may be easily atomized without a concentration phenomenon.

According to the present invention, the fuel atomized by the above-described operation is fed into a final engine through the discharge hole 161 of the second casing 160 and the fuel outlet 170, thereby improving engine efficiency.

Meanwhile, only a single device 100 for enhancing fuel efficiency applied to the present invention may be applied and used. Furthermore, two, three, four, or more devices are assembled together and used, as desired.

In the following description, a case where four devices 100 for enhancing fuel efficiency are connected and used is illustrated for the sake of convenience.

In other words, FIG. 4 is an exploded perspective view for the assembly of four devices for enhancing fuel efficiency, which are applied to the present invention, FIG. 5 is a perspective view of the assembled state of the four devices for enhancing fuel efficiency, which are applied to the present invention, and FIG. 6 is a sectional view of the assembled state of the four devices for enhancing fuel efficiency, which are applied to the present invention.

According the above-described the present invention, the fuel introduced through the inlet hole 210 is distributed to the outside through the plurality of fuel inflow collection grooves 221, and is then fed to the plurality of devices 100 for improving fuel efficiency through the plurality of first fastening holes 222.

Furthermore, the devices 100 for improving fuel efficiency pulverize and atomize fuel by means of the above-described operation, thereby enabling the fuel to be completely combusted.

The atomized fuel discharged from the above-described plurality of devices 100 for improving fuel efficiency is passed through the second fastening hole 232, is fed from the outside to the inside through the fuel discharge collection groove 231, and is then discharged through the outlet hole 241.

INDUSTRIAL APPLICABILITY

The technical spirit of the device for enhancing fuel efficiency according to the present invention may be repeatedly practiced and may actually produce the same results. In particular, the development of technology may be promoted and contribution may be made to the development of the industry by practicing the above-described present invention, and thus the present invention is well worth protection.

The invention claimed is:

1. A device for enhancing fuel efficiency, in order to maximize energy efficiency by atomizing fuel injected into an engine so that the fuel is completely combusted, the device comprising:

a first casing in which first and second rotating pulverizers are disposed at both ends of a first injection hole at a center of the first casing and a fuel inlet is disposed on a right side of the first casing;

a connection part which is disposed on a left side of the first casing and in which a second injection hole is formed in a center of the connection part, wherein a spiral discharge groove is formed in the connection part, so that the fuel is rapidly transferred to an outside of the connection part and then atomized;

a second casing which is disposed on a left side of the connection part and in which a fuel outlet is disposed on a left, discharge hole side of the second casing; and a fuel guide means which is disposed inside the second casing and which includes first, second, third, and fourth guide tubes and first and second rotating guide tubes in order to atomize the fuel by pulverizing it and to then transfer the pulverized fuel to a left side of the fuel guide means, wherein an elastic element is disposed inside a left side of the first guide tube and a right end of the first guide tube is brought close to the second injection hole by the elastic element while always maintaining a predetermined distance, and thus the fuel is distributed to the outside so that atomization time is secured.

2. The device of claim 1, wherein oil film formation portions are formed on front end outer circumferential surfaces of the first, second, third, and fourth guide tubes, and the fuel passes through the oil film formation portions, and thus the first, second, third, and fourth guide tubes are leveled thanks to oil film formation.

3. The device of claim 1, wherein multiple-line threads having two or more starting points are formed on an outer circumferential surface of each of the first and second rotating guide tubes and decompose the fuel, so that a large amount of the fuel is easily atomized without a concentration phenomenon.

4. The device of claim 1, further comprising:

in order to connect and use a plurality of the devices for enhancing fuel efficiency, an inlet hole cover through which an inlet hole is formed;

an inflow collection base which is disposed on a left side of the inlet hole cover and in which a plurality of fuel inflow collection grooves are formed on a right side of the inflow collection base in contact with the inlet hole cover and a plurality of first fastening holes are formed on a left side of the inflow collection base, wherein a plurality of the devices for improving fuel efficiency are disposed in the first fastening holes;

a discharge collection base which is disposed on a left side of the devices for improving fuel efficiency and in which a plurality of second fastening holes are formed on a right side of the discharge collection base and a plurality of fuel discharge collection grooves are formed on a left side thereof in contact with an outlet hole cover; and the outlet hole cover through which an outlet hole is formed and which is disposed on the left side of the discharge collection base.

5. The device of claim 4, wherein:

fuel introduced into the inlet hole is distributed to an outside of the inflow collection base through the plurality of fuel inflow collection grooves, and is then fed to the plurality of devices for improving fuel efficiency through the plurality of first fastening holes;

the devices for improving fuel efficiency pulverize and atomize the fuel so that the fuel can be completely combusted; and the fuel discharged from the plurality of devices for improving fuel efficiency is passed through the second fastening hole, is fed from an outside to an inside of the discharge collection base through the fuel discharge collection grooves, and is discharged through the outlet hole.

* * * * *